US007021273B1

(12) United States Patent
Prucka et al.

(10) Patent No.: US 7,021,273 B1
(45) Date of Patent: Apr. 4, 2006

(54) TRANSITION CONTROL FOR MULTIPLE DISPLACEMENT ENGINE

(75) Inventors: Michael J Prucka, Grass Lake, MI (US); Michael A Bonne, Leonard, MI (US); Alan G Falkowski, Lake Orion, MI (US); Mark J Duty, Goodrich, MI (US); Mark R. McElwee, Lake Orion, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 11/087,457

(22) Filed: Mar. 23, 2005

(51) Int. Cl.
*F02B 77/00* (2006.01)

(52) U.S. Cl. ..... 123/198 F

(58) Field of Classification Search ..... 123/198 F
See application file for complete search history.

(56) References Cited

U.S. PATENT DOCUMENTS

| | | | |
|---|---|---|---|
| 4,585,101 | A | 4/1986 | Danno |
| 5,374,224 | A | 12/1994 | Huffmaster et al. |
| 5,408,974 | A | 4/1995 | Lipinski et al. |
| 5,568,795 | A | 10/1996 | Robichaux et al. |
| 5,611,754 | A | 3/1997 | Haga et al. |
| 5,806,012 | A | 9/1998 | Maki et al. |
| 5,839,409 | A | 11/1998 | Denz et al. |
| 5,970,943 | A | 10/1999 | Robichaux et al. |
| 6,311,670 | B1 | 11/2001 | Constancis |
| 6,360,713 | B1 | 3/2002 | Kolmanovsky et al. |
| 6,615,804 | B1 | 9/2003 | Matthews et al. |
| 6,655,353 | B1 | 12/2003 | Rayl |
| 6,736,108 | B1 | 5/2004 | Rayl et al. |
| 6,752,121 | B1 | 6/2004 | Rayl et al. |
| 6,782,865 | B1 | 8/2004 | Rayl et al. |
| 6,843,752 | B1 | 1/2005 | Bolander |
| 2002/0157640 | A1 | 10/2002 | Matthews et al. |
| 2002/0162540 | A1 | 11/2002 | Matthews et al. |
| 2004/0244744 | A1 | 12/2004 | Falkowski et al. |
| 2004/0244751 | A1 | 12/2004 | Falkowski et al. |

OTHER PUBLICATIONS

Bates, B.; Dosdall, J. M.; and Smith, D. H.; "Variable Displacement by Engine Valve Control," SAE Paper No. 780145 (New York, NY; 1978).

Mueller, Robert S.; and Uitvlugt, Martin W.; "Valve Selector Hardware," SAE Publication No. 780146 (New York, NY; 1978).

Fukui, Toyoaki; Nakagami, Tatsuro; Endo, Hiroyasu; Katsumoto, Takehiko; and Danno, Yoshiaki; "Mitsubishi Orion-MD—A New Variable Displacement Engine," SAE Paper No. 831007 (New York, NY; 1983).

(Continued)

*Primary Examiner*—Noah P. Kamen
(74) *Attorney, Agent, or Firm*—Ralph E. Smith

(57) ABSTRACT

A process for enabling cylinder deactivation in a multiple displacement engine involving oil aeration includes detecting engine speed. Once the engine speed has been determined, a delay period is established prior to enabling cylinder deactivation. The delay period is a function of whether engine speed exceeds a preselected threshold and an amount by which the threshold is exceeded. When the delay period expires, a request is generated for cylinder deactivation.

17 Claims, 2 Drawing Sheets

OTHER PUBLICATIONS

Hatano, Kiyoshi; Iida, Kazumasa; Higashi, Hirohumi; and Murata, Shinichi; "Development of a New Multi-Mode Variable Valve Timing Engine," SAE Paper No. 930878 (New York, NY; 1993).

McElwee, Mark; and Wakeman, Russell; "A Mechanical Valve System with Variable Lift, Duration, and Phase Using a Moving Pivot," SAE Paper No. 970334 (New York, NY; 1997).

Yacoub, Yasser; and Atkinson, Chris; "Modularity in Spark Ignition Engines: A Review of its Benefits, Implementation and Limitations," SAE Publication No. 982688 (New York, NY; 1998).

Zheng, Quan; "Characterization of the Dynamic Response of a Cylinder Deactivation Valvetrain System," SAE Publication No. 2001-01-0669 (New York, NY; 2001).

Leone, T.G.; and Pozar, M.; "Fuel Economy Benefit of Cylinder Deactivation—Sensitivity to Vehicle Application and Operating Constraints," SAE Paper No. 2001-01-3591 (New York, NY; 2001).

Patton, Kenneth J.; Sullivan, Aaron M.; Rask, Rodney B.; and Theobald, Mark A.; "Aggregating Technologies for Reduced Fuel Consumption: A Review of the Technical Content in the 2002 National Research Council Report on CAFÉ," SAE Paper No. 2002-01-0628 (New York, NY; 2002).

Falkowski, Alan G.; McElwee, Mark R.; and Bonne, Michael A.; "Design and Development of the Daimlerchrysler 5.71 Hemi Engine Multi -Displacement Cylinder Deactivation System," SAE Publication No. 2004-01-2106 (New York, NY, May 7, 2004).

2004 Global Powertrain Congress program, Sep. 28-30, 2004, Ford Conference & Event Center, Dearborn, Michigan, USA (9 pages).

Albertson, William, et al [William Albertson, Thomas Boland, Jia-shium Chen, James Hicks, Gregory P. Matthews, Micke McDonald, Sheldon Plaxton, Allen Rayl, Frederick Rozario], "Displacement on Demand for Improved Fuel Economy Without Compromising Performance in GM's High Value Engines," Powertrain International—2004 Global Powertrain Conference, Sáline, Michigan, Sep. 29, 2004.

TRANSITION CONTROL FOR MULTIPLE DISPLACEMENT ENGINE

FIELD OF THE INVENTION

The present invention relates to a transition control for a Multiple Displacement Engine based on the amount of oil aeration in the engine.

BACKGROUND OF THE INVENTION

In a vehicle, a Multiple Displacement System (MDS) employs a means of activating and deactivating cylinders in a gasoline engine to improve fuel economy. For example, in an MDS vehicle utilizing an eight cylinder engine (i.e. V8 mode), the MDS computes a requested power by an operator of the vehicle needed to perform and maintain engine speed and vehicle load. The requested power is determined based on a position of an accelerator pedal depressed by the operator. If the MDS decides that the engine can operate and satisfy the requested power of the operator utilizing four of the eight cylinders (i.e. V4 mode), then the MDS deactivates four selected cylinders in the engine, producing less power and energy in the deactivated cylinders. While in V4 mode, if the operator changes the requested power of the engine and the engine cannot deliver the requested power in V4 mode, the MDS reactivates the previously deactivated four cylinders and transitions from V4 mode to V8 mode. In addition to monitoring the power requested by the operator, the MDS monitors other environmental parameters and conditions within the vehicle in order to determine whether to deactivate or activate cylinders in the engine.

One method and system of deactivating and activating cylinders utilizes a decoupling mechanism in a lifter, hydraulically actuated by oil pressure (i.e. an electro-hydraulic system). An engine oil pump supplies oil under pressure to an electro-hydraulic solenoid valve located within an oil flow control valve. The electro-hydraulic solenoid valve controls the oil pressure to a locking mechanism in a lifter by adding and removing the oil pressure. When a camshaft is on its base circle and the oil pressure in a lifter control gallery rises, the locking mechanism deactivates and decouples from the camshaft. Once the lifter decouples from the camshaft, both an intake valve and an exhaust valve close sealing the cylinder such that no air or fuel flows into or out of the cylinder, causing a piston in the cylinder to deactivate. In order to reactivate the cylinder, voltage is removed from the electro-hydraulic solenoid valve causing the oil flow control valve to close and reduce the oil pressure in the lifter control gallery. Thus, the electro-hydraulic system's behavior is a direct function of the oil pressure and an amount of air contained within an oil system (i.e. oil aeration) of an engine.

One element contributing to a phenomenon of increasing the amount of oil aeration in the oil system is engine speed. As engine speed increases in the vehicle, oil contained in an oil pan of the engine becomes agitated around by a crankshaft, causing an undesirable amount of oil aeration that then travels from the oil pan throughout the oil system. When the oil system contains desirable amounts oil aeration and oil pressure, activating and deactivating cylinders in the engine is a repeatable and accurate process. However, if an undesirable amount of oil aeration or oil pressure exists, the process of activating and deactivating cylinders is nonrepeatable and inaccurate.

SUMMARY OF THE INVENTION

A process for enabling cylinder deactivation in a multiple displacement engine involving oil aeration includes detecting engine speed. Once the engine speed has been detected, a delay period is established prior to enabling cylinder deactivation. The delay period is a function of whether engine speed exceeds a preselected threshold and an amount by which the threshold is exceeded. When the delay period expires, a request is generated for cylinder deactivation.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application or uses.

Figure 1:
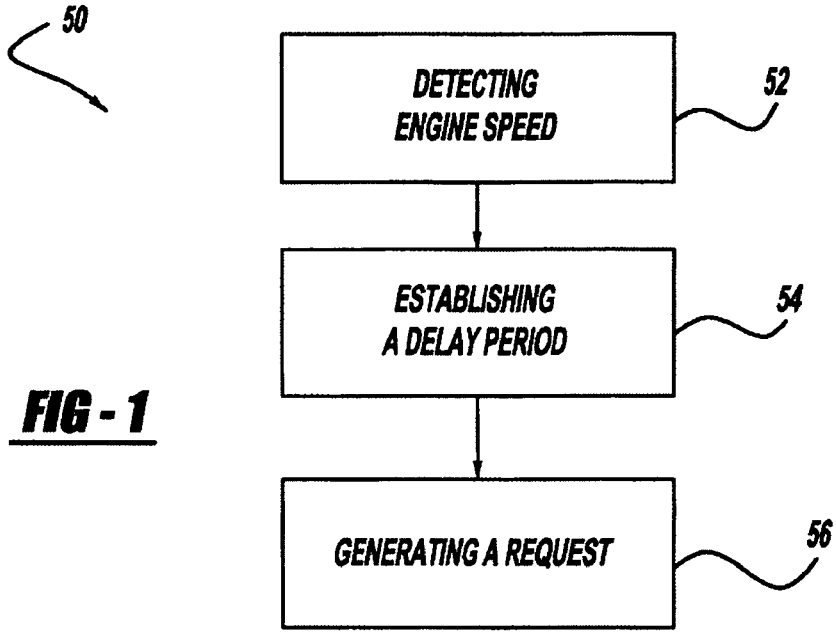
FIG. 1 is a flow chart of a process for enabling cylinder deactivation in a multiple displacement engine involving oil aeration.

FIG. 1 illustrates a process 50 for enabling cylinder deactivation in a Multiple Displacement System (MDS) when the oil system in a vehicle includes a desirable amount of oil aeration. The process begins by continuously detecting engine speed, as shown at step 52. After detecting engine speed, a delay period is established prior to enabling cylinder deactivation, where the delay period is a function of whether engine speed exceeds a preselected threshold and an amount by which the threshold is exceeded at step 54. When the delay period expires, a request is generated for cylinder deactivation at step 56.

Figure 2:
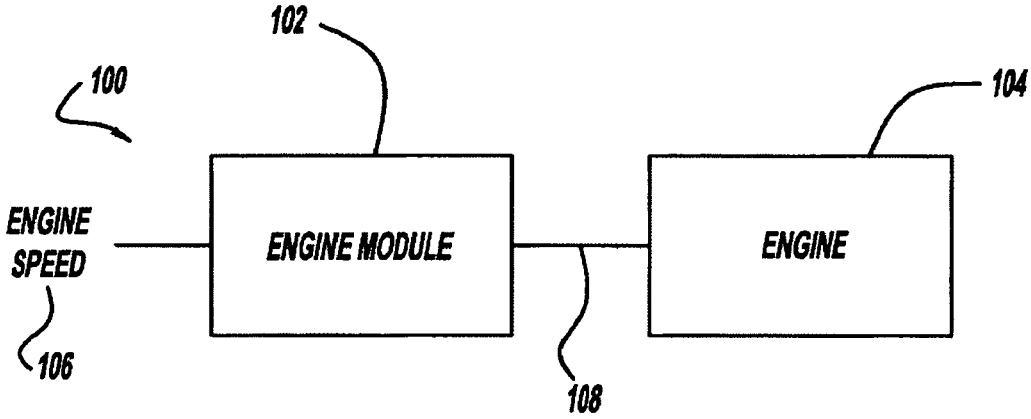
FIG. 2 is a block diagram of a computer implemented system for implementing a method for enabling cylinder deactivation in a multiple displacement engine.

An exemplary software-implementation system 100 for implementing this process 50 is further described in relation to FIG. 2. The system 100 includes an engine module 102 and an engine 104 in the vehicle. The engine module detects engine speed 106 and establishes a delay period prior to requesting cylinder deactivation. The delay period is a function of whether engine speed 106 exceeds a preselected threshold and an amount by which the threshold is exceeded. The engine in the vehicle is connected to the engine module 102. Upon receiving a request 108 for cylinder deactivation, the engine module 102 deactivates selected cylinders located within the engine 104.

Figure 3:
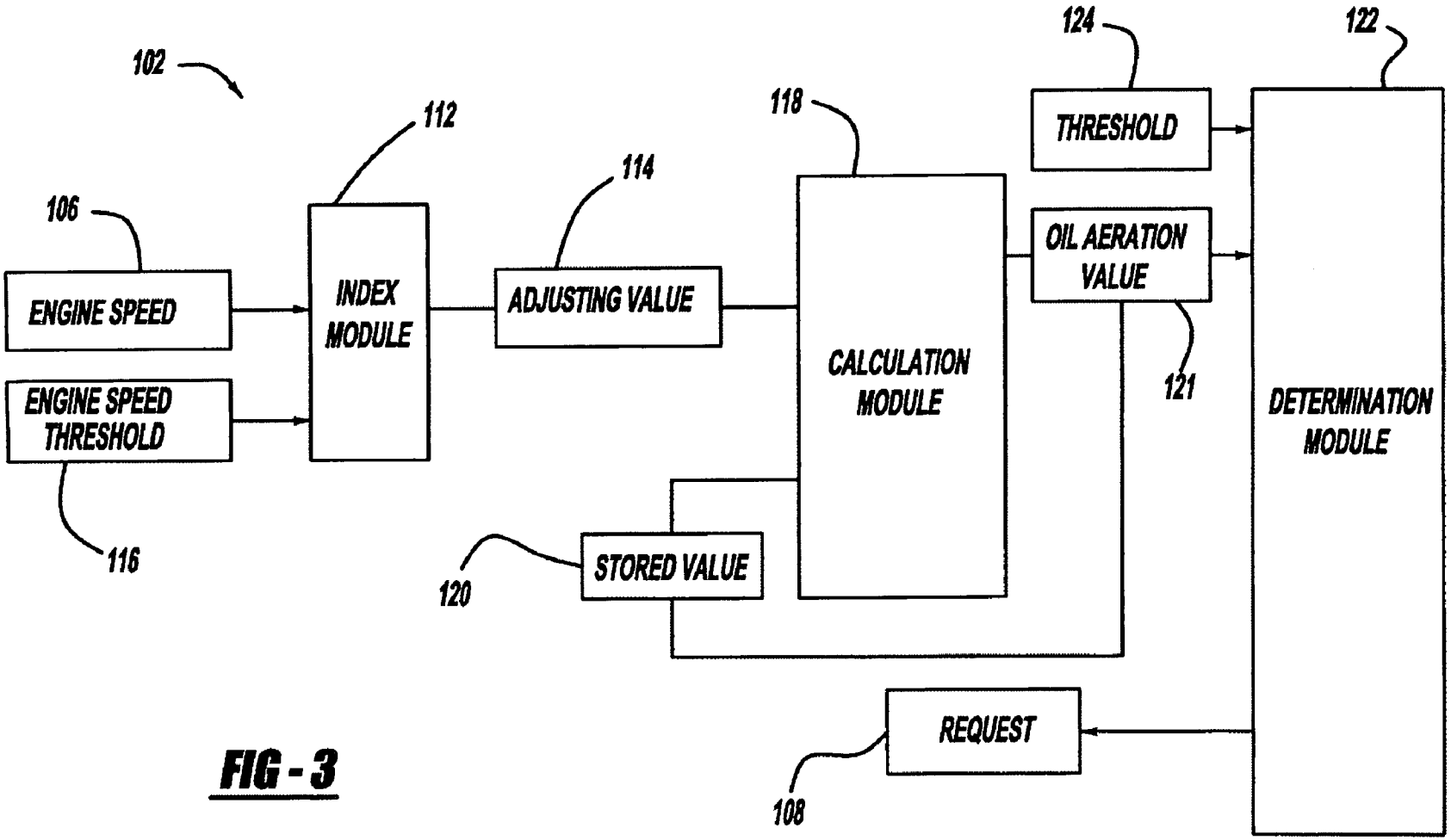
FIG. 3 is a block diagram of a further detailed description of a computer implemented system for enabling cylinder deactivation in a multiple displacement engine based on oil aeration.

Referring to FIG. 3, the engine module 102 includes an index module 112, a calculation module 118 and a determination module 122. In the preferred embodiment, the index module 112 is coupled to the calculation module 118. Additionally, the calculation module 118 is coupled to the determination module 122.

Engine speed 106 is fed into the index module 112 from the vehicle. While detecting engine speed 106, the index module 112 determines an adjusting value 114 based on a function of a disparity between engine speed 106 and a predetermined engine speed threshold 116. The adjusting value 114 is indicative of an amount of undesirable oil aeration entering and leaving the engine 104. If engine speed 106 is greater than the engine speed threshold 116 then an undesirable amount of oil aeration is entering into the engine 104; and, the index module 112 increments the calculation module 118 using the adjusting value 114. On the other hand, if engine speed 106 is less than the engine speed threshold 116, the undesirable amount of oil aeration is leaving the engine 104; and, the index module 112 decrements the calculation module 118 using the adjusting value 114.

As the disparity increases by which engine speed 106 exceeds the engine speed threshold 116, the index module 112 increases the adjusting value 114 used to increment the calculation module 118. However, as engine speed 106 decreases below the engine speed threshold 116, the index module 112 decreases the adjusting value 114 used to decrement the calculation module 118.

Additionally, the index module 112 is calibrated to increment and decrement the calculation module 118 at a predetermined rate of speed. The index module 112 increments the calculation module 118 at a faster speed than decrementing the calculation module 118 such that a speed of incrementing and decrementing the calculation module 118 models a behavior of a rate of speed in which the undesirable oil aeration enters and leaves the oil system caused by engine speed 106.

When the adjusting value 114 is received from the index module 112, the calculation module 118 combines the adjusting value 114 with a previously stored undesirable oil aeration value 120 to produce an undesirable oil aeration value 121 that corresponds to a total amount of undesirable oil aeration in the engine 104. Upon determining the undesirable oil aeration value 121, the calculation module 118 compares the undesirable oil aeration value 121 to a predetermined minimum value (not shown). When the undesirable oil aeration value 121 is less than the minimum value, the calculation module 118 resets the undesirable oil aeration value 121 to equal the minimum value. Thereafter, the undesirable oil aeration value 121 is stored in the calculation module 118, as the previously stored value 120.

Additionally, the calculation module 118 sends the undesirable oil aeration value 121 to the determination module 122. Upon receipt of the undesirable oil aeration value 121, the determination module 122 compares the undesirable oil aeration value 121 to a desirable oil aeration threshold 124. If the undesirable oil aeration value 121 exceeds the desirable oil aeration threshold 124, the determination module 122 enables the delay period. On the other hand, if the undesirable oil aeration value 121 equals the desirable oil aeration threshold 124, the determination module 122 disables the delay period and sends the request 108 for cylinder deactivation in the engine 104.

As previously mentioned, there are many environmental parameters and conditions that may prevent the MDS from deactivating or reactivating cylinders in the engine 104. Oil aeration caused by engine speed 106 is only one of such environmental parameters and conditions. Therefore, while the oil aeration request may be enabled, the MDS may not deactivate cylinders due to other environmental parameters and conditions set in the system.

Additionally as used in this description, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A process for enabling cylinder deactivation in a multiple displacement engine, the process comprising:

determining engine speed;

establishing a delay period prior to enabling cylinder deactivation, where the delay period is a function of whether engine speed exceeds a preselected threshold and an amount by which the threshold is exceeded; and generating a request for cylinder deactivation when the delay period ends.

2. The process of claim 1 wherein the threshold comprises that engine speed which causes undesirable oil aeration in a vehicle.

3. The process of claim 1 wherein establishing the delay period further comprises:

determining an adjusting value that correlates to an amount of oil aeration entering and leaving an oil system in a vehicle, wherein the adjusting value is a function of an amount of disparity between engine speed and the threshold;

computing a total value of oil aeration contained in the oil system based on incrementing and decrementing a previously stored total value using the adjusting value;

storing the total value such that a stored total value is retrievable to compute a new total value; and enabling a delay period based on a function of the total value exceeding a desirable oil aeration threshold over which the oil system may not deactivate cylinders.

4. The process of claim 3 further comprising:

limiting the total value to a predetermined minimum value such that the total value is equal to or greater than the minimum value; and resetting the total value to equal the minimum value where the total value is less than the minimum value.

5. The process of claim 3 wherein computing the total value of oil aeration further comprises incrementing the previously stored total value using the adjusting value based on a function of engine speed exceeding the threshold.

6. The process of claim 3 wherein computing the total value of oil aeration further comprises decrementing the previously stored total value using the adjusting value based on a function of engine speed descending below the threshold.

7. The process of claim 3 further comprising determining the speed of incrementing and decrementing the stored total value.

8. The process of claim 7 further comprising incrementing the total value at a faster speed then decrementing the stored total value.

9. The process of claim 3 further comprising varying the adjusting value as the disparity varies between engine speed and the threshold.

10. The process of claim 9 further comprising increasing the adjusting value as engine speed exceeds the threshold.

11. The process of claim 9 further comprising decreasing the adjusting value as engine speed descends below the threshold.

12. A system for enabling cylinder deactivation in a vehicle with a multiple displacement engine utilizing engine oil based hydraulics to activate and deactivate cylinders in an engine, the system comprising:

an engine module detecting engine speed and establishing a delay period prior to generating a request for cylinder deactivation, where the delay period is a function of whether engine speed exceeds a preselected threshold and an amount by which the threshold is exceeded; and an engine in the vehicle coupled to the engine module, where the engine module, upon enabling the request for cylinder deactivation, deactivates selected cylinders within the engine.

13. The system of claim 12 wherein the threshold comprises that engine speed which causes undesirable oil aeration.

14. The system of claim 12 wherein the engine module further comprises:

an index module determining an adjusting value, where the index module correlates the adjusting value to a difference in amount between engine speed and the threshold such that the adjusting value is indicative of an amount of oil aeration entering and leaving the engine;

a calculation module coupled to the index module, where the index module increments and decrements the calculation module using the adjusting value to determine a total value of undesirable oil aeration that exists in the engine;

a determination module coupled to the calculation module and limiting the total value to a predetermined minimum value, where the limiting module resets the total value to equal the minimum value when the total value is less than the minimum value, the determination module enables the delay period based on a function of whether the total value exceeds a predetermined desirable oil aeration value in the engine to allow cylinder deactivation; and wherein the calculation module stores the total value.

15. The system of claim 14 wherein the index module varies the adjusting value as the difference in amount varies between engine speed and the threshold.

16. The system of claim 14 wherein the index module determines a speed of incrementing and decrementing the calculation module.

17. The system of claim 16 wherein the index module increments the calculation module at a faster speed than the index module decrements the calculation module such that the speed of incrementing and decrementing the calculation module models a behavior of undesirable oil aeration entering and leaving the oil system caused by engine speed.

* * * * *